US005598996A

United States Patent [19]

Rath

[11] Patent Number: 5,598,996

[45] Date of Patent: Feb. 4, 1997

[54] ADJUSTABLE TARGET STAND

[76] Inventor: Scott A. Rath, 2353 Mehaffey Bridge Rd. NE., North Liberty, Iowa 52317

[21] Appl. No.: 249,369

[22] Filed: May 27, 1994

[51] Int. Cl.[6] ..... F14J 1/10

[52] U.S. Cl. ..... 248/163.1; 248/166; 273/407

[58] Field of Search ..... 248/163.1, 122, 248/165, 156, 166, 284.1, 298.1, 440.1; 273/407; 40/610

[56] References Cited

U.S. PATENT DOCUMENTS

| | | | |
|---|---|---|---|
| 1,505,046 | 8/1924 | Lush | 248/163.1 |
| 2,538,118 | 1/1951 | Miller | 273/407 |
| 2,722,420 | 11/1955 | Adamson | 273/407 |
| 3,080,166 | 3/1963 | Clark | 273/407 |
| 3,087,701 | 4/1963 | Wallace | 273/407 X |
| 3,540,729 | 11/1970 | Rahberger | 248/156 X |
| 4,637,615 | 1/1987 | Foreman | 40/610 X |
| 5,067,683 | 11/1991 | Wager | 248/156 X |

FOREIGN PATENT DOCUMENTS

| | | | |
|---|---|---|---|
| 2502526 | 7/1976 | Germany | 273/407 |

*Primary Examiner*—Derek J. Berger
*Attorney, Agent, or Firm*—James C. Nemmers

[57] ABSTRACT

The stand of the invention consists of a pair of legs angled slightly upwards in the center and to each of which is affixed a perpendicular pivot pin upon which is mounted a horizontal crossbar. The crossbar slides over the pivot pins and is secured by means of set screws. Upon said crossbar are mounted perpendicular vertical uprights affixed to sleeves which are secured by set screws, and the uprights thus may be positioned in infinite positions longitudinally along the crossbar.

6 Claims, 4 Drawing Sheets

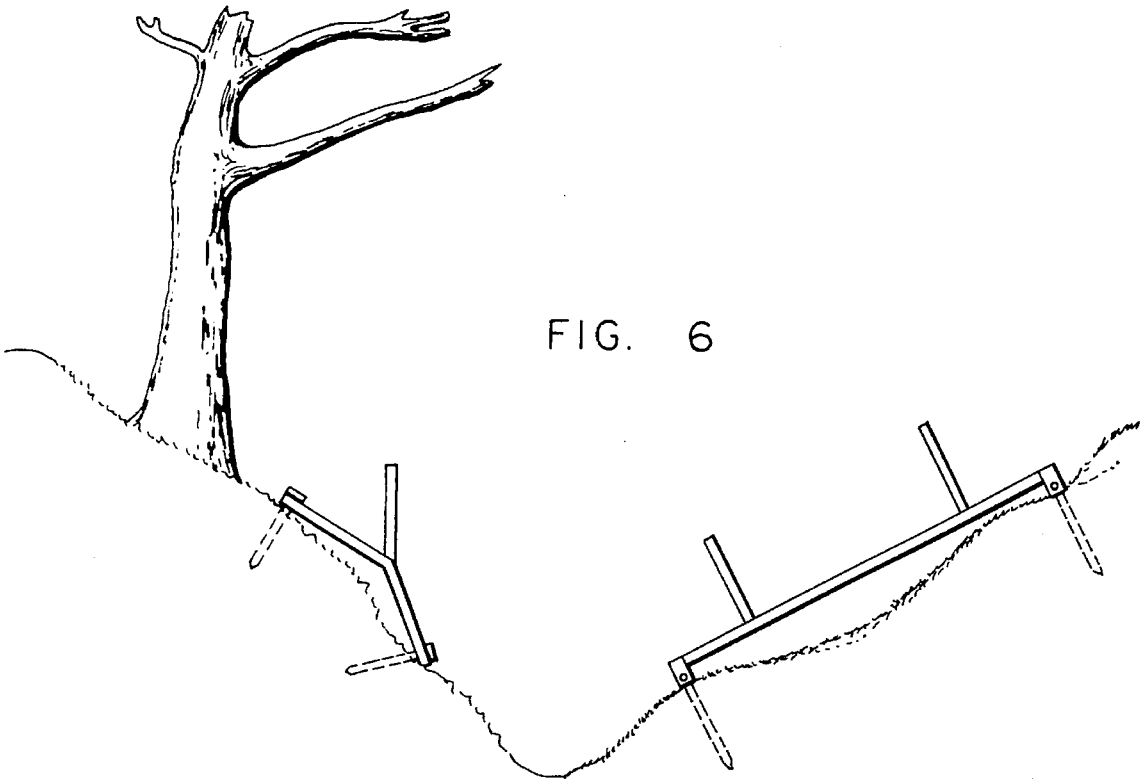
FIG. 6
FIG. 5
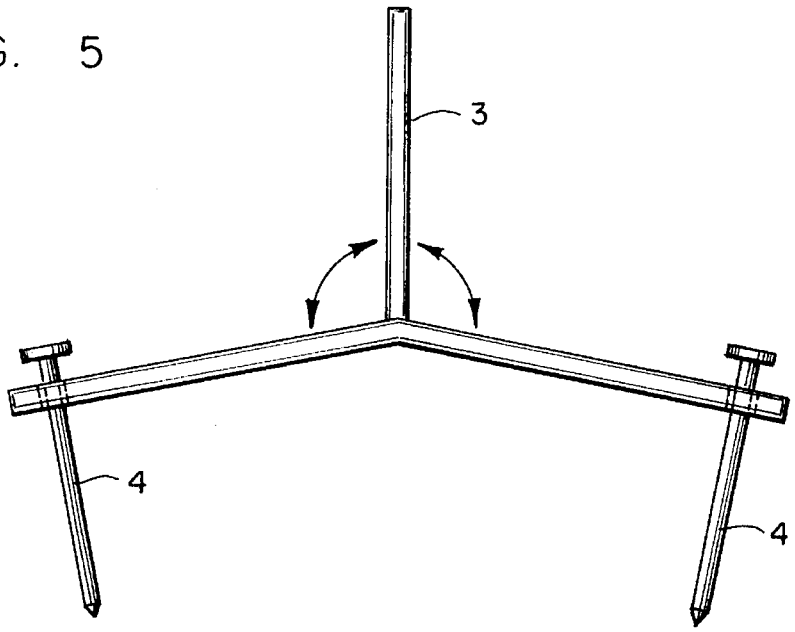

ADJUSTABLE TARGET STAND

BACKGROUND OF THE INVENTION

1. Field of the Invention:

The invention relates to stands for supporting large archery targets, such as three-dimensional, life-size animal-like targets.

2. Description of the Prior Art:

Three dimensional target archery is a relatively new sport with modern three dimensional targets emerging only during recent years. This sport is commonly known as 3-D Archery. This sport is conducted in natural outdoor settings as well as indoors. Prior to the introduction of these new three dimensional life-size animal-like targets, the need for an infinitely adjustable stand for these targets which adapts to all terrain conditions was not identified.

Today there are a wide variety of three dimensional targets being made by numerous manufacturers with new models emerging on the market frequently. These three dimensional targets share a similar design in construction while they differ in size just as the real animals they emulate. The three dimensional targets are molded of dense ethafoam and painted to be as lifelike as possible in much the same manner as duck and goose decoys. The life-size modern three dimensional targets are constructed with two (2) to four (4) vertical hollow metal conduit inserts molded into the legs of the three dimensional target "animal." It is the intent of the manufacturers that modern three dimensional targets be mounted on ground penetration devices consisting of steel rods of corresponding diameter and necessary length driven into the ground at each target's particular leg spacing and at such an angle as to mount the target "animal" in natural vertical position.

Although there are numerous stands available for two dimensional targets, none are capable of supporting the wide variety of life-size three dimensional archery targets which require an infinite independent adjustability while adapting to all terrain conditions. Ground penetration devices are time consuming and difficult to install at the proper spacing and angle and are useless on hard surfaces and indoors.

There is a definite need for a means of mounting these unique targets in a secure manner while complimenting their natural appearance in a wide variety of terrain conditions.

There are no known devices currently available to adequately address the need that the invention fulfills. Although there are numerous stands available with and without legs for two dimensional paper targets for firearm use, signs, frames or other items of minimal mass, there are none capable of providing the necessary support for the wide variety of massive life-size three dimensional archery targets while also providing infinite independent adjustability and the ability to adapt to all terrain conditions.

SUMMARY OF THE INVENTION

The adjustable target stand of the invention includes two or three legs depending on the size of the target being used. The legs are joined by a crossbar and the legs pivot independently of the crossbar thereby allowing an upright support slidably mounted on the crossbar to hold the target in the desired position. Each leg is anchored by anchor pins when used outdoors, or the legs can be anchored by placing sandbags on each leg when the stand is used in an interior environment.

BRIEF DESCRIPTION OF THE DRAWINGS

The Invention is more fully understood by referencing the following detailed description when read in conjunction with the accompanying drawings in which:

FIG. 5 is an end elevational view of the stand;

FIG. 6 is a view showing the stand from the end and front and positioned on irregular terrain to illustrate the ability of the stand to maintain a target in a natural upright position on irregular terrain;

DESCRIPTION OF THE PREFERRED EMBODIMENTS OF THE INVENTION

Figure 1:
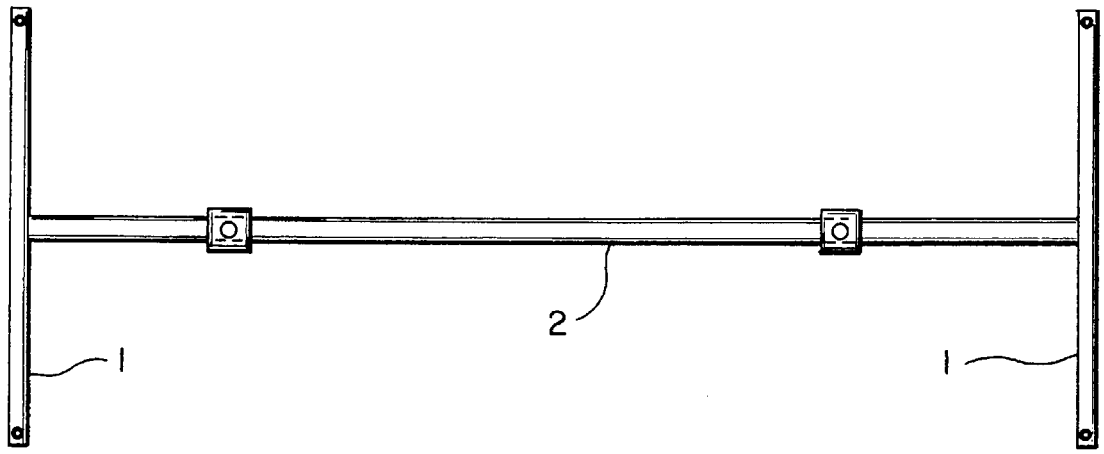
FIG. 1 is a top or plan view of an adjustable target stand constructed according to the principles of the invention.
Figure 2:
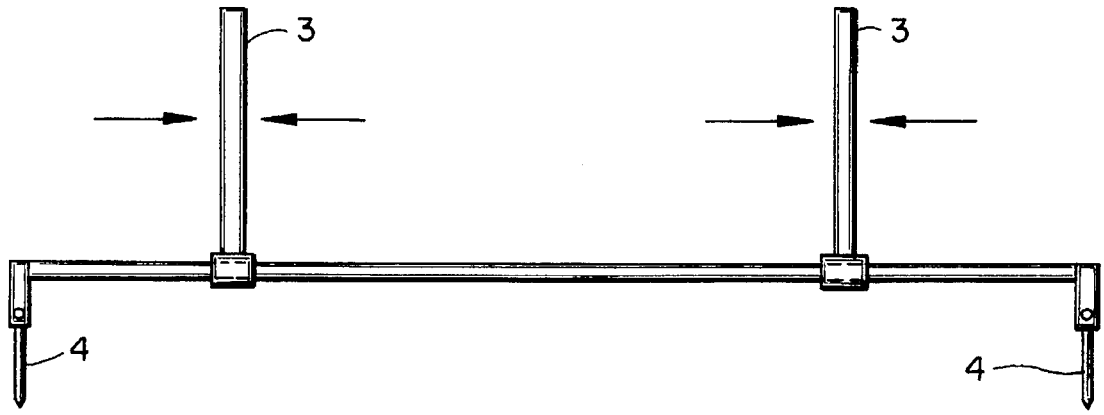
FIG. 2 is a front elevational view of the of the stand of FIG. 1.
Figure 3:
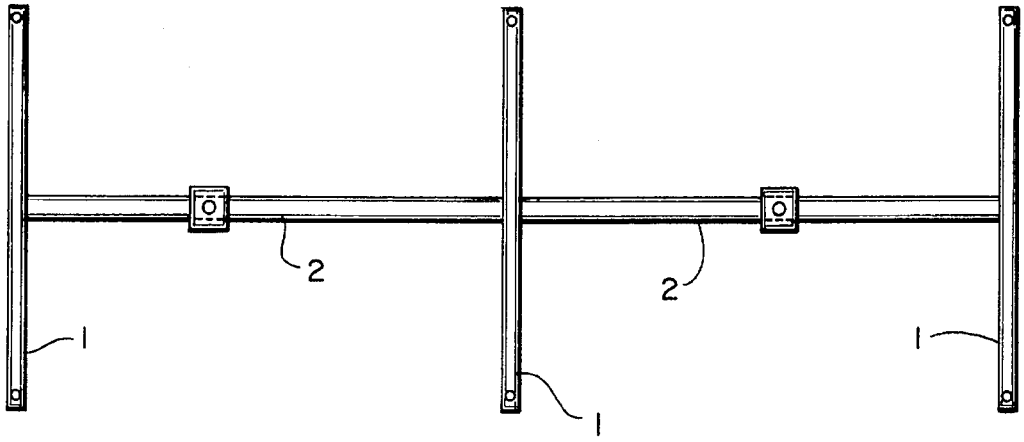
FIG. 3 is a top view similar to FIG. 1 but showing an additional leg on the stand.
Figure 4:
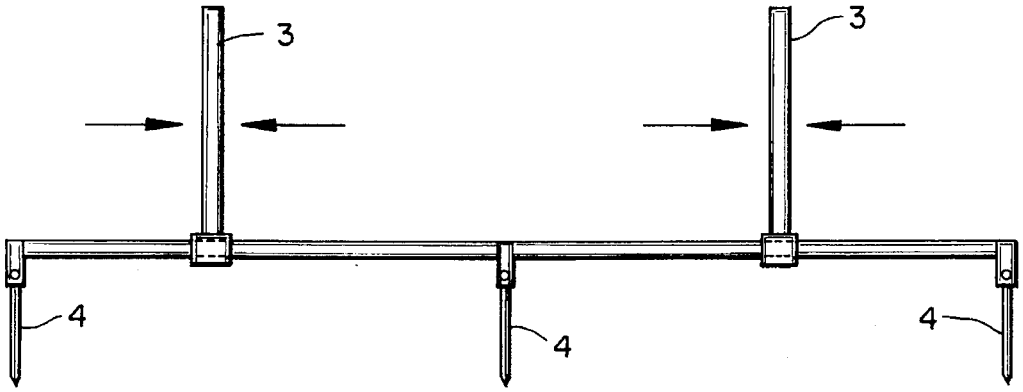
FIG. 4 is a front view similar to FIG. 2 and showing the stand of FIG. 3.
Figure 7:
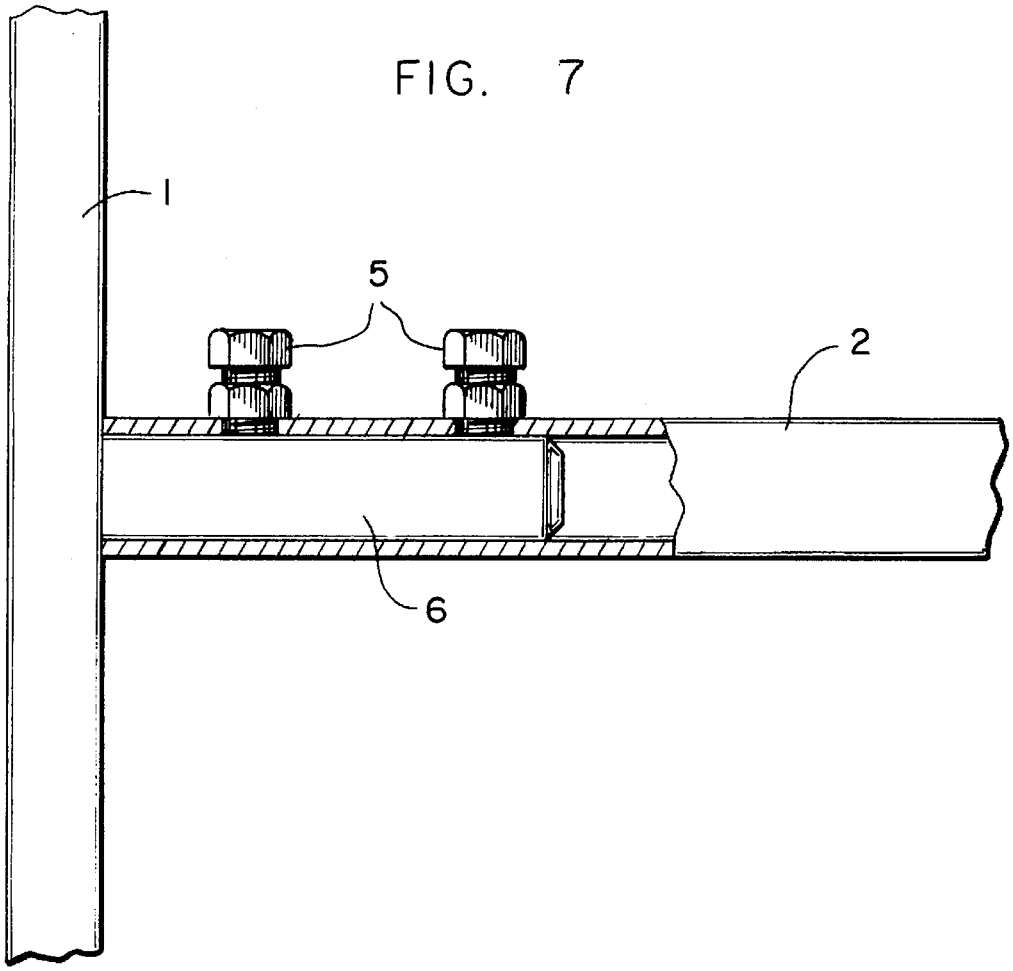
FIG. 7 is an enlarged view partly in section and showing the crossbar and leg connection and the removable sleeve located on one end of this crossbar.

The stand of the invention consists of three basic parts: legs, a crossbar and uprights. Each part is preferably made of steel. In the embodiment of FIGS. 1 and 2, there are two square steel tube legs 1 which are spaced apart and substantially parallel, and in the embodiment of FIGS. 3 and 4, there is also a middle leg 1 parallel to and approximately centered between the other two outer legs 1. Each leg 1 is positioned to rest on a support surface at its outer ends to which there are attached anchor pins 4. The center of each leg 1 extends upwardly where it is joined to the crossbar 2. The higher middle of each leg 1 is to provide adequate clearance for minor surface irregularities on the support surface (such as the ground) so as to assure that each end of said leg 1 will be in solid contact with the support surface. As best seen in FIG. 7, in order to pivotally secure each leg 1 to the crossbar 2, there is welded to the center of each leg 1 a pivot pin 6 of solid steel round stock which pin 6 extends perpendicularly inwardly to engage the inside end of the crossbar 2. This provides for rotation of the legs 1 relative to the crossbar 2 and gives each of the two legs 1 infinite independent adjustability to compensate for any surface angle from flat to nearly vertical while keeping a target supported on the stand in a true vertical (plumb) aspect.

A single crossbar 2 preferable made of square steel tubing is attached at each end to the pivot pin 6 of each leg 1 so as to lie in a parallel position to the support surface. The inside dimension of the crossbar 2 is slightly larger than the diameter of the pivot pin 6 allowing the attachment to be accomplished by sliding each end of the crossbar 2 over the pivot pin 6. The attachment is then secured by tightening two set screws 5 on each end of the crossbar 2 (see FIG. 7). Each the pin 6 engages against the inside wall of the crossbar 2 locking it in position and providing for infinite independent adjustability of each leg 1 to compensate for any surface angle from flat to nearly vertical while keeping the target in a true vertical (plumb) aspect.

Figure 8:
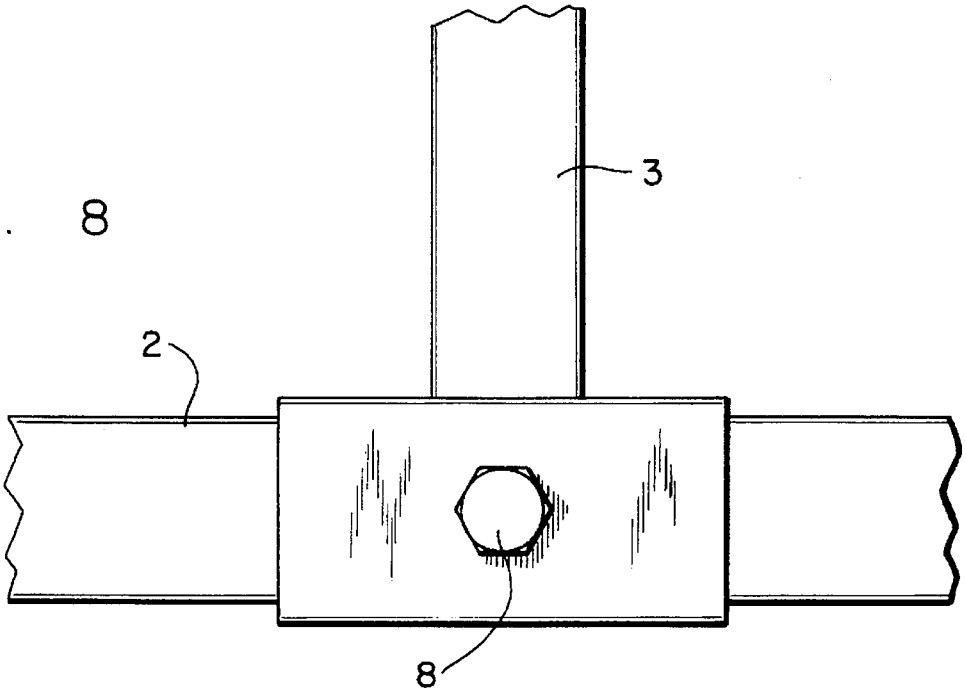
FIG. 8 is an enlarged view showing the removable upright support and crossbar connection which allows horizontal adjustment to accommodate targets of different sizes.

A short length of square steel tubing providing a sleeve 7 is slidably attached to the crossbar 2 so as to slide freely along the crossbar 2. There are two such sleeves 7 and a vertical upright 3 is welded or otherwise suitably attached to each sleeve 7. This permits infinite independent adjustment of each upright 3 longitudinally along the entire length of the crossbar 2. Any desired position of an upright 3 is maintained by tightening a set screw 8 (see FIG. 8). The length and diameter of each upright 3 is dependent upon the requirements of the particular various life-size three dimensional archery target with which the stand of the invention is being used. The uprights 3 are interchangeable.

The adjustable target stand of the invention solves all the problems inherent with known designs which utilize steel rods of corresponding diameter and necessary length that are driven into the ground at each three dimensional target's particular leg spacing and at such an angle as to mount the three dimensional target "animal" in a natural vertical position. Hard surfaces such as rock, concrete and indoor floors prohibit the use of these ground penetration devices. Also, soft terrain such as mud, dirt, sand and saturated ground renders these ground penetration devices unreliable. The kinetic energy expended by arrows impacting the three dimensional target and the removal of the arrows loosens ground penetration devices causing the three dimensional targets to lean or fall. The ground penetration devices are time consuming and difficult to install at the proper spacing and angle. The stand of the invention provides a wide weight-distributing support base to compensate for the high center of gravity and substantial mass of the target on hard as well as soft terrain conditions. With the stand of the invention, no ground penetration devices are required but may be used to hold the stand in place where conditions permit.

The infinite adjustability of the stand of the invention accommodates all leg spacing of the life-size modern three dimensional targets. The stand of the invention is infinitely adjustable to accommodate most terrain irregularities while maintaining the target in its natural vertical position.

The invention offers a simpler more expedient method of effectively placing the life-size modern three dimensional targets in virtually any desired location and provides the base for a multiplicity of accessories such as wheels for mobility and other devices rendering it capable of providing support for all types of conventional targets, archery paper-tuner, bow holder and the like as their utility is identified while still maintaining its infinite adjustability and its all-terrain ability.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

I claim:

1. A target support stand for supporting on a support surface life-size three dimensional archery targets of substantial mass in an upright plumb position on different terrain conditions, said stand comprising: a pair of laterally spaced apart legs adapted to be positioned generally parallel to the support surface, each of said legs having outer ends and a central portion extending upwardly to a level above the outer ends, a crossbar attached to the legs at their central portions and extending between the legs, pivotal attachment means providing for pivotal movement of the legs in planes perpendicular to the crossbar and providing for locking of each leg independent of the other leg in a selected position relative to the crossbar, a pair of target supports pivotally secured at their lower ends to the crossbar and extending upwardly so as to provide for pivotal movement of the target supports in planes substantially perpendicular to the crossbar, adjustable means providing for independent positioning of each target support at a selected position along the crossbar, and anchor means combined with the legs to provide additional stability to the support stand.

2. The target support stand of claim 1 in which the pivotal attachment means for each leg includes a pivot pin extending inwardly from the central portion of the leg toward the other leg, the crossbar being attached to the pivot pins.

3. The target support stand of claim 2 in which the pivotal attachment means also includes of set screws combined with each pivot pin and crossbar to provide for infinite and independent adjustability of each leg relative to the crossbar through 360 degrees of rotation.

4. The target support stand of claim 2 in which the pivotal attachment means also includes a sleeve on one end of the crossbar which provides for detachment of the crossbar from one of the legs, thereby providing for installation and removal of the target supports.

5. The target support stand of claim 2 in which the adjustable means for positioning each target support includes sleeves slidably positionable along the crossbar, a target support being affixed to each sleeve, and locking means is combined with each target support sleeve to lock the target support in a selected position along the crossbar and in a selected pivotal position.

6. The target support stand of claim 5 in which the locking means includes a set screw combined with the target support sleeve and the crossbar.

* * * * *